US005276480A

United States Patent [19]

Takahashi

[11] Patent Number: 5,276,480

[45] Date of Patent: Jan. 4, 1994

[54] IMAGE FORMING DEVICE

[75] Inventor: Kazunobu Takahashi, Nara, Japan

[73] Assignee: Sharp Kabushiki Kaisha, Abeno, Japan

[21] Appl. No.: 880,832

[22] Filed: May 11, 1992

[30] Foreign Application Priority Data

May 20, 1991 [JP] Japan ..... 3-115009

[51] Int. Cl.[5] ..... G03G 15/00

[52] U.S. Cl. ..... 355/200; 355/210

[58] Field of Search ..... 355/200, 203, 210, 211, 355/282

[56] References Cited

U.S. PATENT DOCUMENTS 4,750,015 6/1988 Ogura et al. ..... 355/203
4,943,815 7/1990 Aldrich et al. ..... 355/210 X

FOREIGN PATENT DOCUMENTS 59-60449 4/1984 Japan .
60-117269 6/1985 Japan .
61-219060 9/1986 Japan .
63-243975 10/1988 Japan .
2-304581 12/1990 Japan .

OTHER PUBLICATIONS

Communication from the corresponding German Patent Office dated Apr. 21,1993 with translation.

*Primary Examiner*—A. T. Grimley
*Assistant Examiner*—Shuk Y. Lee
*Attorney, Agent, or Firm*—David G. Conlin; Henry D. Pahl, Jr.

[57] ABSTRACT

An image forming device of clamshell type has an upper frame and a lower frame. The upper frame has a bottom face and includes an optical unit for emitting a scanning light. The lower frame has a photosensitive body therein and supports the upper frame openably around the horizontal supporting shaft. The bottom face of the upper frame has an exposure port for emitting the scanning light to expose the photosensitive body in the lower frame. The device is provided with a light shield plate, supported inside the upper frame rotatably by a first fixed shaft, for closing the exposure port. A torsion coil spring is wound around the first fixed shaft and urges the light shield plate in the direction of closing the exposure port. The light shield plate is connected to a prime mover supported in the upper frame rotatably by a second fixed shaft through a connecting rod in such a manner that the turn of the prime mover about the second fixed shaft causes the turn of the light shield plate about the first fixed shaft. The lower frame is provided with a working body coming into contact with the prime mover and turning it against a force of the torsion coil as the upper frame is closed to open the exposure port.

7 Claims, 6 Drawing Sheets

IMAGE FORMING DEVICE

BACKGROUND OF THE INVENTION

1. Field of the Invention

This invention relates to an image forming device, and more particularly to an image forming device of a laser printer, a copying machine, or the like, which has a clamshell type frame.

2. Description of the Related Art

Some image forming devices of laser printers, copying machines, etc. have a clamshell type frame in a structure which can be opened and closed around a horizontal axis. Image forming devices of this type have upper and lower frames, and the upper frame is supported openably by the supporting shaft of the lower frame. The upper frame includes an optical unit for emitting a scanning light. The lower frame has mounted detachably thereto a process unit comprising a photosensitive body and a developing device. The upper frame has a bottom face, and in this bottom face there is formed an exposure port for emitting the scanning light from the optical unit for exposure of the photosensitive body.

In the image forming device, an electrical interlock mechanism is provided, such as a safety switch, which prevents the optical unit from operating when the upper frame is opened, and also a mechanical light shielding mechanism is provided which enables to shield light from the optical unit when the optical unit is put into operation mistakenly by an electrical trouble of the above-mentioned interlock mechanism.

This light shielding mechanism comprises a shield plate having a L-like cross section, which is rotatably supported at one end on a fixed shaft in the upper frame, and is arranged such that the light shield plate closes the exposure port by an urging force of a spring when the upper frame is opened. The fact that the exposure port is closed when the upper frame is opened not only ensures that the light is actually blocked when the optical unit is put into operation by mistake, but also gives the user a sense of security that the scanning light is not irradiated.

A working lever is provided, protruding upward, at the top of the process unit in the lower frame, which lever is used to turn the light shield plate about the fixed shaft in the printing condition that the upper frame is closed. At the bottom face of the upper frame, there is provided an opening for the working lever to enter the upper frame and comes into contact with the light shield plate when the upper frame is closed. Thus, when the upper frame is closed, the working lever contacts the light shield plate at the working point, and the light shield plate is turned about the fixed shaft to open the exposure port.

In the light shielding mechanism described, the opening angle, hence, the turning angle $\theta$ of the light shield plate is determined by the length and working point of the working lever. Desirably, the opening angle is sufficiently large. To this end, it is necessary to set the working point close to the exposure port or set the working point away from the exposure point and make the working lever larger accordingly.

However, making a larger working lever results in the process unit becoming difficult to handle, and this is not desirable in view of the fact that the process unit is treated as an item to be maintained by the user.

Setting the working point close to the exposure port means setting the working lever close to the photosensitive body, and therefore, the opening through which the working lever goes into and comes out of the upper frame becomes close to the photosensitive body. For this reason, through this opening, scattering toner is likely to enter the upper frame, making the optical unit dirty with toner, which has been a problem.

SUMMARY OF THE INVENTION

It is therefore an object of the present invention to provide an image forming device having a scanning light shielding mechanism, which will not be in the way of maintenance and which precludes a possibility that scattering toner enters the upper frame and contaminates the optical unit.

The object of the invention can be achieved by an image forming device comprising: an upper frame having a bottom face and including an optical unit for emitting a scanning light; a lower frame having a photosensitive body therein and supporting the upper frame openably; the bottom face of the upper frame having an exposure port for emitting the scanning light to expose the photosensitive body in the lower frame; a light shield plate, supported in the upper frame rotatably by a first fixed shaft, for opening and closing the exposure port; a prime mover supported in the upper frame rotatably by a second fixed shaft; a connecting rod, connecting said prime mover and said light shield plate, for turning said light shield plate by turning of said prime mover; urging means for urging the light shield plate in the direction of closing the exposure port; and a working body, provided in the lower frame, for turning the prime mover against a force of the urging means to open the exposure port.

A fixing unit may be mounted in the lower frame, and the working body may be mounted on the fixing unit so as to protrude therefrom, and the first fixed shaft of the light shield plate may be disposed above the photosensitive body, the second fixed shaft of the prime mover may be disposed above the fixing unit, and the working body may come into contact with and away from the prime mover as the upper frame is closed and opened.

In the bottom face of the upper frame, there may be provided an opening for the working body to enter the upper frame therethrough and may come into contact with the prime mover.

The light shield plate may be a flat plate, wider than the exposure port, held at one end thereof by a supporting member.

The prime mover may be a plate having a substantially triangular cross section and a corner thereof remotest from said exposure port may be supported by the second fixed shaft.

One end of the connecting rod may be mounted rotatably through the intermediary of the first shaft to a lower portion of the supporting member of the light shield plate.

The urging means may be a torsion coil spring wound around the first fixed shaft.

In the construction described above, when the upper frame is in closed state, the working body is in contact with the prime mover and turns the prime mover against the force of the urging means, thereby turning the light shield plate in the direction of opening the exposure port, so that exposure of the photosensitive body by the scanning light is secured.

If paper jamming occurs while an image is formed, or when changing the fixing unit or the developing cartridge in the lower frame, the upper frame is opened. At this time, the working body of the lower frame comes away from the prime mover, so that the light shield plate is turned by the urging means to close the exposure port.

Therefore, when the upper frame has been opened, the exposure port is closed by the light shield plate. Even if the optical unit operates, the light does not leak.

Moreover, when changing the developing cartridge, for example, even if toner scatters, the toner does not enter the optical unit because the exposure port is closed, and at the bottom face of the upper frame the working position of the working body to the prime mover is away from the sensitive body, so that toner does not enter through the opening by which the working body enter the upper frame.

Further objects and advantages of the present invention will be apparent from the following description of the preferred embodiment of the invention as illustrated in the accompanying drawings.

DESCRIPTION OF THE PREFERRED EMBODIMENT

Figure 3:
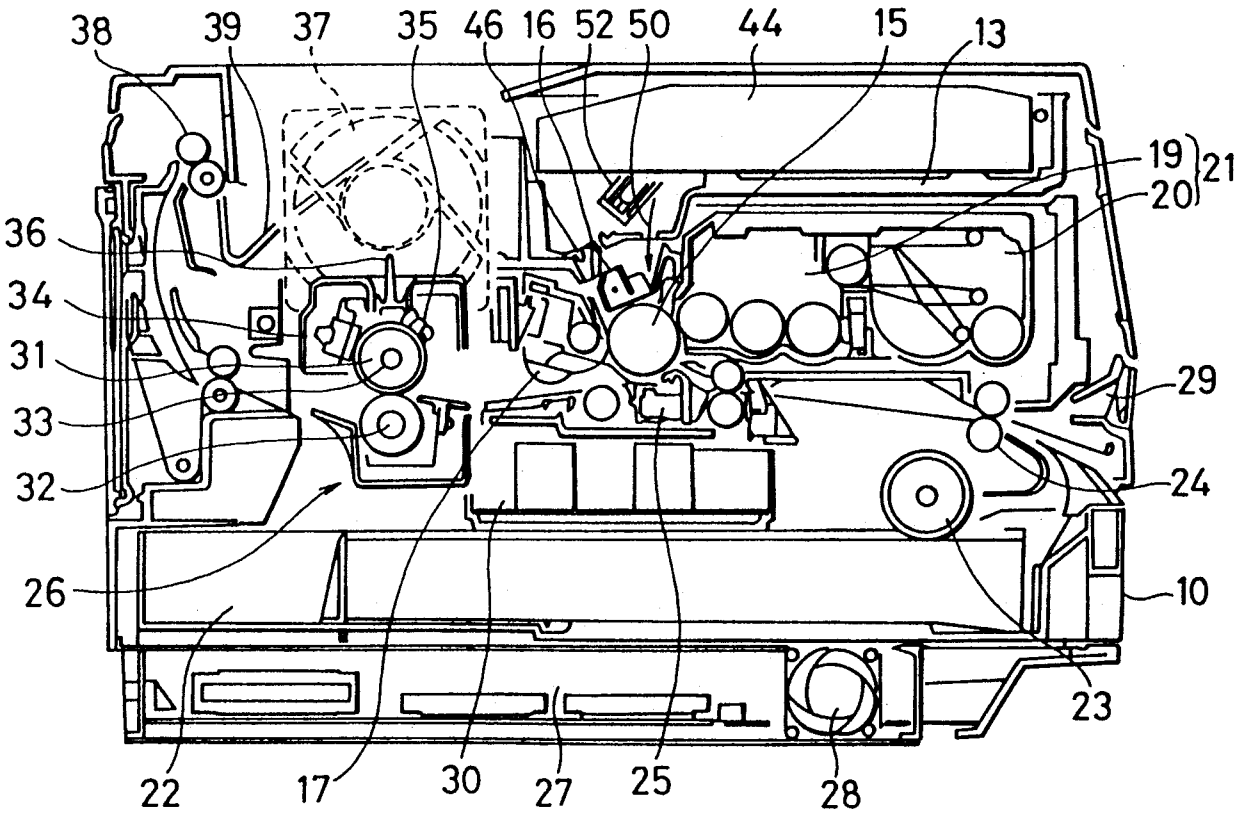
FIG. 3 is a sectional view of the whole image forming device.

An embodiment of the present invention will be described with reference to the accompanying drawings. A laser printer as an image forming device according to this embodiment comprises a middle frame 12 and an upper frame 13 openably supported by a support shaft 11 attached to a lower frame 10 as shown in FIGS. 3 and 4.

The upper frame 13 includes an optical unit 14. The middle frame 12 includes a drum cartridge incorporating a photosensitive body 15, an electric charging device 16, and a cleaning device 17 combined as a single body, and also includes a developing cartridge 21 incorporating a developing vessel 19 and a toner supply vessel 20 combined as a single body.

The lower frame 10 includes a paper cassette 22, a paper feeding roller 23, a conveying roller 24, an image transfer device 25, and a fixing unit 26.

Figure 4:
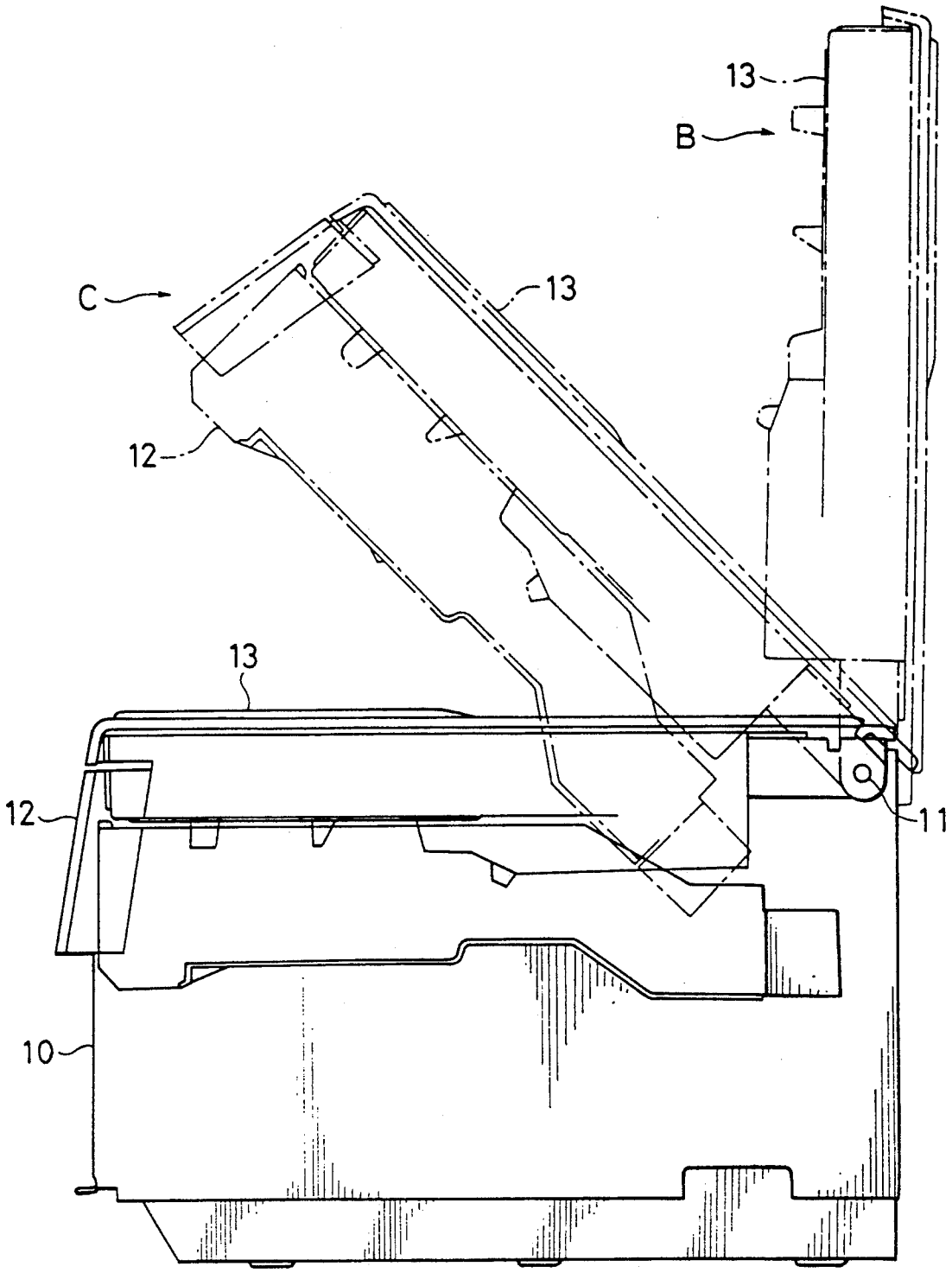
FIG. 4 is a side view of the image forming device with the upper frame opened.
Figure 5:
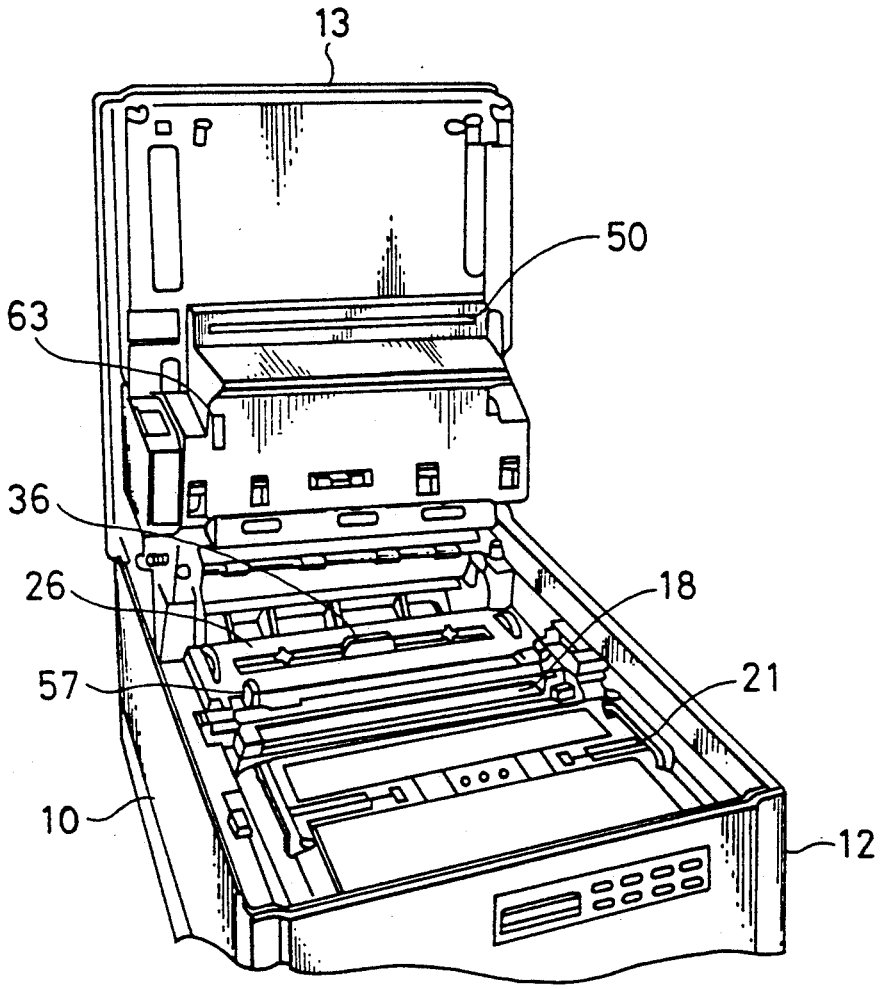
FIG. 5 is a perspective view of the image forming device with the upper frame opened.
Figure 6:
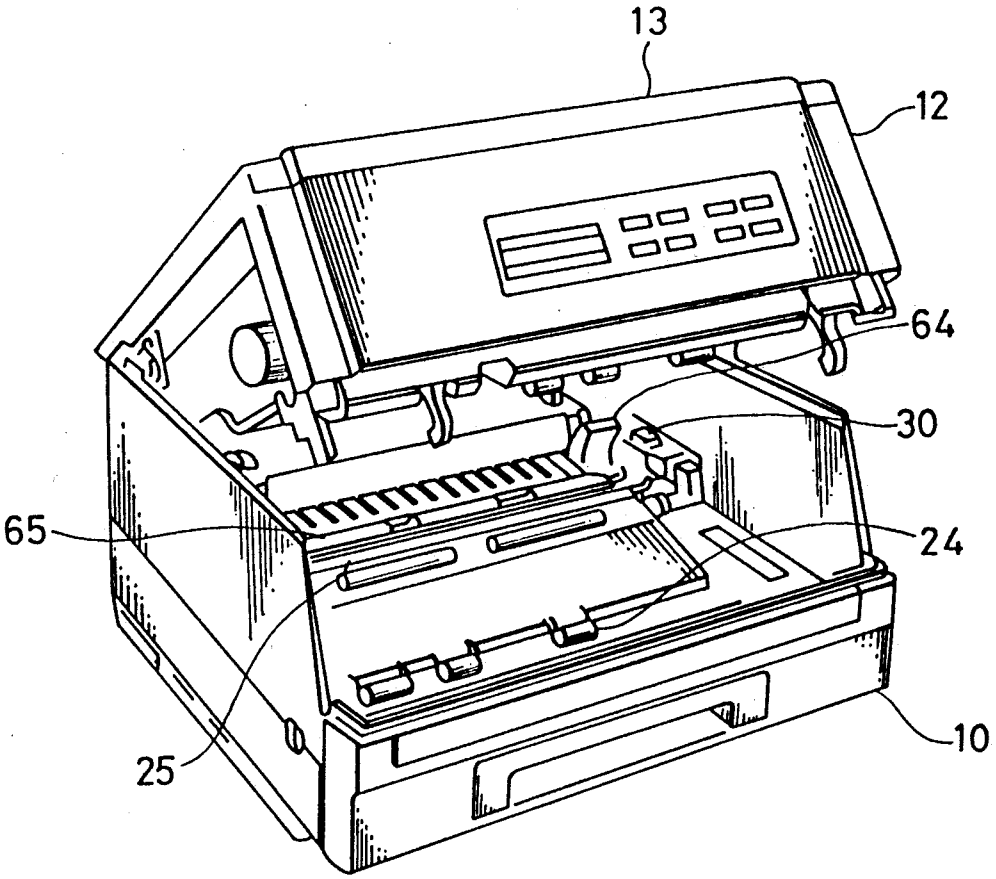
FIG. 6 is a perspective view of the image forming device with the upper and middle frame opened.

When replacing the drum cartridge 18 or the developing cartridge 21, an open/close mechanism (not shown) is used to open only the upper frame 90° as shown in FIG. 5 and by the B state in FIG. 4. When removing a paper jamming which occurred while an image was formed, the open/close mechanism (not shown) is used to open the upper frame 13 and the middle frame 12 as a combined body 45° as shown in FIG. 6 and indicated by the C state in FIG. 4.

In FIG. 3, reference numeral 27 denotes an IC unit board, 28 a fan motor for cooling a printed wiring board, 29 a manual feed port, 30 a waste toner collecting vessel, 31 a fixing roller, 32 a lower heat roller, 33 a heater lamp, 34 as a thermostat, 35 a thermistor, 36 a roller cleaner, 37 a main fan motor, 38 a paper eject roller, 39 an ejected paper tray, and 40 a static elimination lamp.

At the bottom face of the upper frame which is opposed to the photosensitive body 15, there is provided an exposure port 50 for irradiating the photosensitive body 15 with a scanning light from the optical unit 14 for exposure, the exposure port 50 being formed in a long and narrow slot in the longitudinal direction of the photosensitive body 15.

Figure 1:
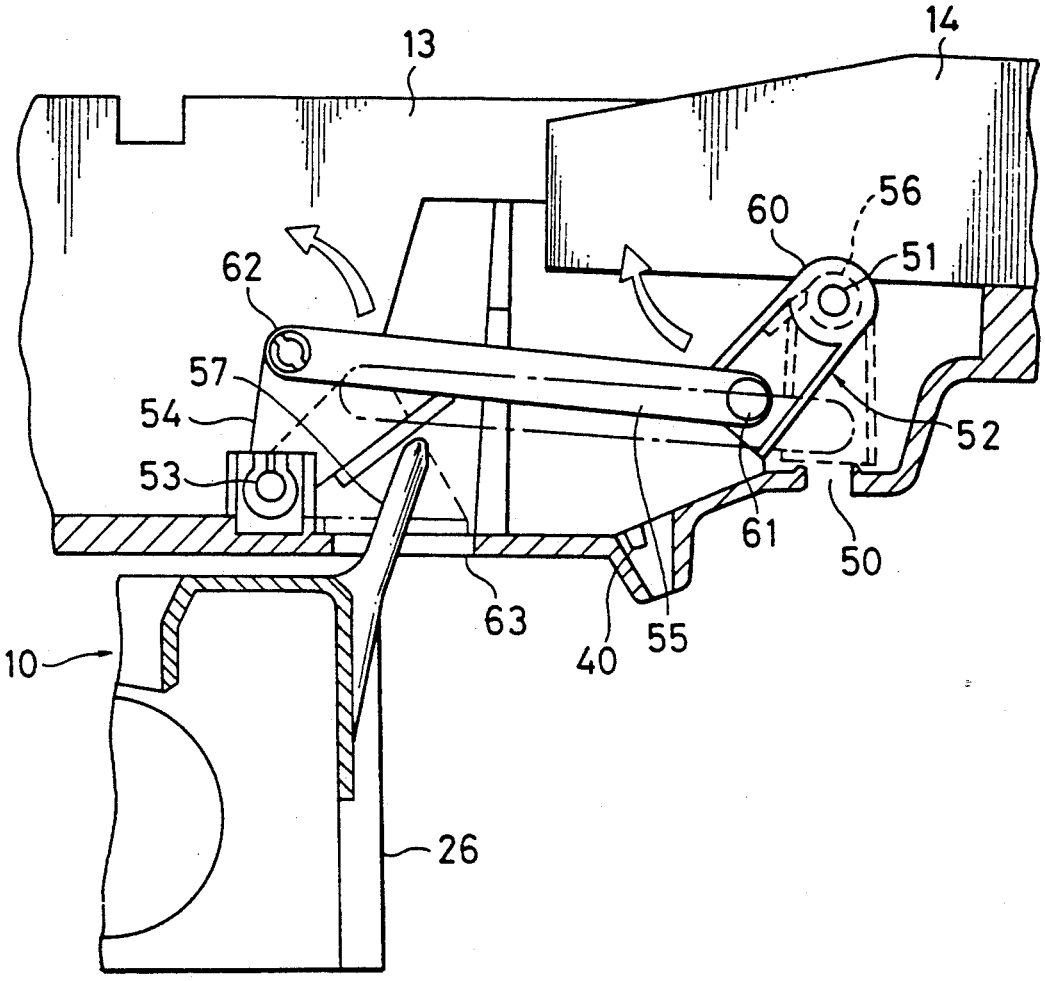
FIG. 1 is a partial sectional view showing the construction of a light shielding mechanism of an image forming device according to an embodiment of the present invention.

As shown in FIG. 1, the upper frame 13 includes a light shield plate 52, supported rotatably by a first fixed shaft 51, for opening and closing the exposure port 50, a prime mover 54 supported rotatably by a second fixed shaft 53, a connecting rod 55, connecting the prime mover 54 and the light shield plate 52, for rotating the light shield plate 52 by turning of the prime mover 54, and urging means 56 for urging the light shield plate 52 in the direction of closing the exposure port 50. The lower frame 10 includes a working body 57 for rotating the prime mover 54 against the force of the urging means 56 in order to open the exposure port 50 when the upper frame 13 is closed.

The above-mentioned light shield plate 52 is a flat plate wider than the exposure port 50 held at one end by a support member 60, and a top portion of the support member 60 is supported by the first fixed shaft 51. The first fixed shaft is mounted inside the upper frame 13 and at an upper position of the fixing unit 26.

The above-mentioned prime mover 54 is a substantially triangular plate, and a corner thereof remotest from the exposure port 50 is supported by the second fixed shaft 53. The second fixed shaft is mounted inside the upper frame 13 and at an upper position of the fixing unit 26.

The above-mentioned connecting rod 55 is at one end thereof mounted rotatably through the intermediary of a first shaft 61 to a lower portion of the support member of the light shield plate 52, and at the other end thereof mounted rotatably through a second shaft 62 to a corner of the top portion of the prime mover 54.

The above-mentioned urging means 56 is a torsion coil spring, and is fitted on the first fixed shaft 51 with an end thereof in contact with the support member 60 of the light shield plate 52. The urging means 56 is urging the light shield plate 52 counter-clockwise in the direction of closing the exposure port 50.

The above-mentioned working body 57 is a rib protruding upward from the fixing unit 26. The upper frame 13 has at the bottom face thereof an insertion port 63 into which the working body 57 can enter. The bottom face of the prime mover 54 is arranged to be above the insertion hole 63, and as the upper frame 13 is closed and opened, the working body 57 comes into contact with and away from the prime mover 54.

In FIG. 6, reference numeral 64 denotes a high voltage unit, and 65 denotes a separation roller.

In the above-mentioned construction, when the upper frame 13 is in closed state, the working body 57 of the fixing unit 26 has gone through the insertion hole 63 into the upper frame 13, and the working body is holding up the bottom face of the prime mover 4 against the force of the urging means 56.

Figure 2:
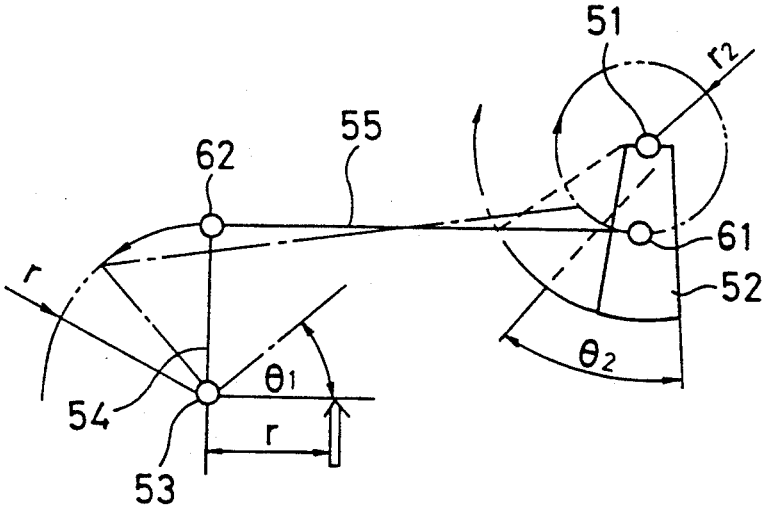
FIG. 2 is a diagram showing the operation of the light shielding mechanism of FIG. 1.

As indicated by alternate long and short dash lines in FIG. 2, the prime mover 54 has turned by $\theta_1$ about the second fixed shaft 53, the light shield plate 52 has turned by $\theta_2$ through the intermediary of the connecting rod 55, and therefore, the exposure port 50 is open. Under this condition, the scanning light from the optical unit 14 passes through the exposure port 50 and is emitted to the photosensitive body 15.

When paper jamming occurs while an image is formed or changing the fixing unit 26, the middle frame 12 is raised along with the upper frame 13, and opened about 45°.

When changing the drum cartridge 18 or the developing cartridge 21, the upper frame only is opened 90°.

Under the conditions mentioned above, the working body 57 of the lower frame 10 has gone out of the upper frame 13, so that the light shield plate 52 is turned counter-clockwise by the urging means 56, thus closing the exposure port 50.

When the upper frame 13 has been opened, the optical unit 14 is not only locked electrically so as not to operate, but the exposure port 50 is closed by the light shield plate 52. Therefore, even if the optical unit 14 operates, light does not leak out of the exposure port 50.

What is more, if toner scatters when changing the developing cartridge 21, because when the upper frame 13 is opened the exposure port 50 is closed, and at the bottom face of the upper frame 13, the insertion hole 63 for the working body 57 is remote from the photosensitive body 15, and there is no opening in the vicinity of the photosensitive body 15, toner never enters the optical unit 14.

As shown in FIG. 2, when the working body 57 is caused to operate at position r from the second fixed shaft 53, by the operating radius $r_1$ and the operating angle $\theta_1$ of the prime mover 54 and the operating radius $r_2$ of the light shield plate 52, an operating angle $\theta_2$ and the operating stroke of the light shield plate 52 are determined. For this reason, it is possible to arbitrarily select the place of installation and set the operating stroke for the prime mover 54 and the working body 57, so that the number of degrees of freedom in design is large and the size reduction of the image forming device becomes possible.

Moreover, the light shield plate 52 is opened and closed by means of a link mechanism, so that the working body 57 protruding from the lower frame 10 can be made small, and can be arranged at a position where the working body 57 is not in the way of replacement of the cartridges, and the image forming device can be maintained easily.

The present invention is not limited to the above embodiment, but obviously, various modifications and alterations may be made to the above embodiment without departing from the scope and spirit of the present invention.

As is apparent from the foregoing description, according to the present invention, the upper frame having a built-in optical unit, includes a light shield plate, supported rotatably by a first fixed shaft, for opening and closing the exposure port, a prime mover supported rotatably by a second fixed shaft, a connecting rod, connecting the prime mover and the light shield plate, for rotating the light shield plate by turning of the prime mover, and urging means for urging the light shield plate in the direction of closing the exposure port, while the lower frame includes a working body for rotating the prime mover against the force of the urging means in order to open the exposure port when the upper frame is closed. Therefore, when the upper frame is opened, the exposure port is closed by the light shield plate, and even if the optical unit should operate, light does not leak from the exposure port.

By the working body position and the operating radius and the operating angle of the light shield plate and the light shield plate operating radius, the operating angle and the operating stroke of the light shield plate are determined. Therefore, it is possible to arbitrarily select the place of installation and set the operating stroke for the prime mover and the working body, so that the number of degrees of freedom in design is large and the reduction in size of the image forming device becomes possible.

The working body is mounted on the fixing unit of the lower frame so as to protrude upward, the first fixed shaft of the light shield plate is arranged above the photosensitive body, the second fixed shaft of the prime mover is arranged above the fixing unit, and the working body which comes into contact with and separates from the prime mover when the upper frame is closed and opened does this motion at a position remote from the photosensitive body. Therefore, even if toner scatters when changing the cartridge, because the exposure port is closed and at the bottom face of the upper frame there is no opening in the vicinity of the photosensitive body, toner never enters the optical unit.

Since the prime mover and the connecting rod are used to open and close the light shield plate, the working body protruding from the lower frame can be reduced in size and located at a position where the working body does not interfere with changing of the cartridge or the like, and the image forming device can be maintained easily.

Many widely different embodiments of the present invention may be constructed without departing from the spirit and scope of the present invention. It should be understood that the present invention is not limited to the specific embodiments described in the specification, except as defined in the appended claims.

What is claimed is:

1. An image forming device comprising:

an upper frame having a bottom face and including an optical unit for emitting a scanning light;

a lower frame having a photosensitive body therein and supporting said upper frame pivotally, said upper frame being movable between an open position and a closed position;

the bottom face of said upper frame having an exposure port for emitting the scanning light to expose the photosensitive body in said lower frame when the upper frame is in its closed position;

light shield plate, supported in said upper frame rotatably by a first fixed shaft, for opening and closing said exposure port;

a prime mover supported in said upper frame rotatably by a second fixed shaft spaced from said first shaft;

a connecting rod, connecting a first portion of said prime mover to said light shield plate, for turning said light shield plate by turning of said prime mover, said prime mover including also a second, engagable portion;

urging means for urging said light shield plate in the direction of closing said exposure port; and a working body provided in said lower frame and adapted to contact the engagable portion of said prime mover as said upper frame is moved to its closed position thereby to rotate said light shield plate against a force of said urging means to open said exposure port.

2. An image forming device according to claim 1, wherein a fixing unit is mounted in said lower frame, wherein said working body is mounted on said fixing unit so as to protrude therefrom, wherein said first fixed shaft of said light shield plate is disposed above said photosensitive body, wherein said second fixed shaft of said prime mover is disposed above said fixing unit, and wherein said working body comes into contact with and separates from said prime mover as said upper frame is closed and opened.

3. An image forming device according to claim 1, wherein in the bottom face of said upper frame, there is provided an opening for said working body to enter said upper frame therethrough and comes into contact with said prime mover.

4. An image forming device according to claim 1, wherein said light shield plate is a flat plate, wider than said exposure port, held at one end thereof by a supporting member.

5. An image forming device according to claim 4, wherein said prime mover is a plate having a substantially triangular cross section and a corner thereof remotest from said exposure port is supported by said second fixed shaft.

6. An image forming device according to claim 5, wherein one end of said connecting rod is mounted rotatably through the intermediary of said first shaft to a lower portion of the supporting member of said light shield plate.

7. An image forming device according to claim 6, wherein said urging means is a torsion coil spring wound around said first fixed shaft.

* * * * *